US011828120B2

(12) United States Patent
Alsaif et al.

(10) Patent No.: US 11,828,120 B2
(45) Date of Patent: Nov. 28, 2023

(54) ISOLATED ELECTRICAL SUBMERSIBLE PUMP (ESP) MOTOR

(71) Applicant: Saudi Arabian Oil Company, Dhahran (SA)

(72) Inventors: Abdolrahman A. Alsaif, Riyadh (SA); Francis E. Dominguez, Arvada, CO (US); Laurie S. Duthie, Ras Tanura (SA); Cleavant Flippin, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 80 days.

(21) Appl. No.: 17/694,461

(22) Filed: Mar. 14, 2022

(65) Prior Publication Data

US 2023/0287749 A1 Sep. 14, 2023

(51) Int. Cl.

| | |
|---|---|
| ***E21B 23/06*** | (2006.01) |
| ***E21B 33/12*** | (2006.01) |
| ***E21B 17/02*** | (2006.01) |
| ***E21B 43/12*** | (2006.01) |

(52) U.S. Cl.
CPC ..... *E21B 23/06* (2013.01); *E21B 17/028* (2013.01); *E21B 33/12* (2013.01); *E21B 43/128* (2013.01)

(58) Field of Classification Search
CPC ..... E21B 23/06; E21B 17/028; E21B 33/12; E21B 43/128
See application file for complete search history.

(56) References Cited

U.S. PATENT DOCUMENTS

| | | | | |
|---|---|---|---|---|
| 2,989,121 | A * | 6/1961 | Brown | E21B 33/122 166/134 |
| 5,145,007 | A | 9/1992 | Dinkins | |
| 5,478,970 | A * | 12/1995 | Lawler | H01R 13/523 174/77 R |
| 6,119,780 | A * | 9/2000 | Christmas | E21B 43/128 166/66.4 |
| 6,325,143 | B1 * | 12/2001 | Scarsdale | E21B 43/128 166/54.1 |
| 6,497,278 | B1 * | 12/2002 | Norris | E21B 34/066 166/242.3 |
| 6,964,299 | B2 * | 11/2005 | Scarsdale | E21B 43/128 417/244 |
| 7,231,978 | B2 * | 6/2007 | Rivas | E21B 43/128 166/305.1 |
| 7,487,838 | B2 * | 2/2009 | Knight | E21B 43/128 166/306 |
| 7,730,937 | B2 | 6/2010 | Head | |
| 8,291,983 | B2 * | 10/2012 | Rooks | E21B 43/128 166/107 |
| 8,316,938 | B2 * | 11/2012 | Al-Jarri | E21B 43/20 166/265 |

(Continued)

*Primary Examiner* — Steven A MacDonald
(74) *Attorney, Agent, or Firm* — Fish & Richardson P.C.

(57) ABSTRACT

A completion configuration and a method for an electrical submersible pump (ESP) are provided. An exemplary completion configuration includes a dual port packer, a tubing line mounted in a first port of the dual port packer, wherein the tubing line carries fluid from a reservoir to a surface, and a motor head mounted in a second port of the dual port packer, wherein the motor head couples to ESP power terminations that are disposed uphole of the dual port packer.

22 Claims, 6 Drawing Sheets

(56) References Cited

U.S. PATENT DOCUMENTS

| | | | | |
|---|---|---|---|---|
| 8,997,852 | B1 * | 4/2015 | Lee | E21B 43/128 166/105 |
| 10,844,699 | B2 * | 11/2020 | Xiao | E21B 43/128 |
| 2006/0196660 | A1 * | 9/2006 | Patel | E21B 43/12 166/250.15 |
| 2009/0200034 | A1 * | 8/2009 | Leitch | E21B 43/128 166/321 |
| 2015/0041126 | A1 * | 2/2015 | Boyle | E21B 43/2406 166/57 |
| 2020/0095837 | A1 * | 3/2020 | Bringham | E21B 23/06 |

* cited by examiner

ISOLATED ELECTRICAL SUBMERSIBLE PUMP (ESP) MOTOR

TECHNICAL FIELD

The present disclosure is directed to protecting cable terminations for electrical submersible pumps from degradation caused by exposure to corrosive compounds.

BACKGROUND

The production of crude oil often produces corrosive compounds, such as hydrogen sulfide, among others. These compounds can damage downhole equipment, such as electrical submersible pumps (ESPs) used to produce fluids from a well. The cable terminations to the electrical connections of the ESP are a weak point that can fail after long-term exposure to the corrosive compounds, leading to high cost workovers. Research has been directed to coating the cable terminations with materials that are resistant to attack by corrosive materials. However, research into other techniques for protecting the cable terminations has continued.

SUMMARY

Embodiments described herein provide a completion configuration for an electrical submersible pump (ESP). The completion configuration includes a dual port packer, a tubing line mounted in a first port of the dual port packer, wherein the tubing line carries fluid from a reservoir to a surface, and a motor head mounted in a second port of the dual port packer, wherein the motor head couples to ESP power terminations that are disposed uphole of the dual port packer.

Another embodiment described in examples herein provides a method of protecting power terminations from wellbore fluids. The method includes installing an electrical submersible pump (ESP) in a wellbore, installing a tubing line in the well bore, disposed adjacent to the ESP, and mounting a dual port packer in the wellbore, wherein a motor head for the ESP passes through a first port of the dual port packer, and wherein the tubing line passes through a second port of the dual port packer.

DETAILED DESCRIPTION

Embodiments described in examples herein provides a completion configuration for an ESP that isolates the power cable termination to the motor from the hydrocarbon environment. This will assist in mitigating the impact of $H_2S$, and other fluids, on the electrical components.

Utilizing an inverted ESP configuration, the motor is located above the fluid pump of the ESP. A motor head passes through the dual port packer and the all power cable terminations for the motor are located in the tubing-casing-annulus (TCA) fluid above the packer, while the bulk of the motor will remain below the packer to achieve proper cooling. The produced fluids pass through a tubing line in the second port of the packer. The tubing line can also serve as a bypass for reservoir access, for example, for coiled tubing, tools, and the like. This isolates the cable terminations from the hydrocarbon environment The completion configuration also utilizes a polish bore reciprocal (PBR) with a sealbore packer, placed downhole of the ESP. A PBR is a honed pipe with tight manufacturing tolerances to guarantee sealing properties. The top end of the PBR has a special chamfer to enable easier insertion of The PBR is run independently and set in the well in a separate and preceding run. The packer and ESP assembly are run together and stung into the PBR. The packer elements seal against the internal PBR. This prevents the fluid from circulating downhole after exiting the pump discharge, forcing flow towards perforations on the tubing line that produces the fluid to the surface.

Figure 1:
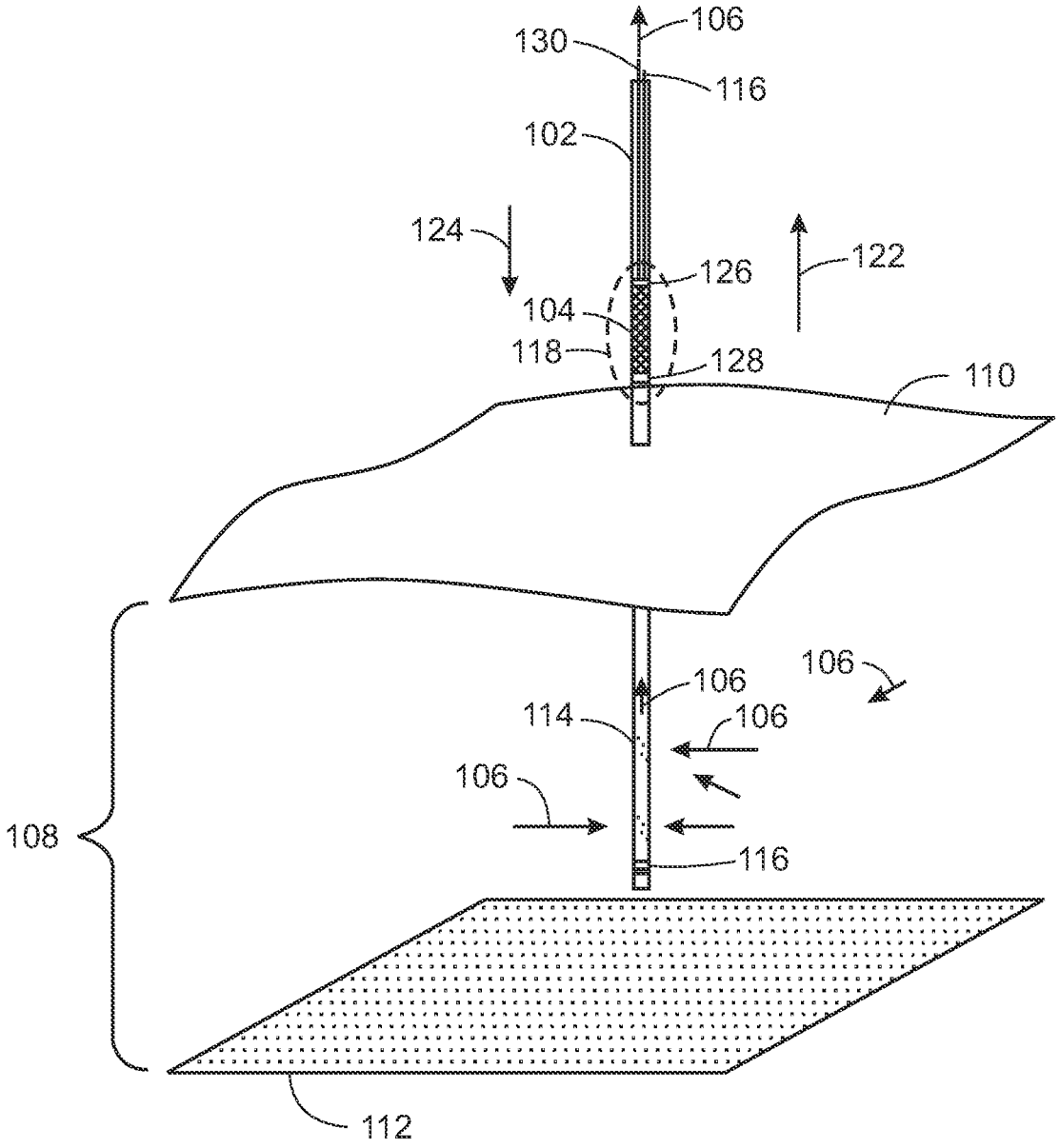
FIG. 1 is a schematic diagram of a wellbore that includes an electrical submersible pump (ESP) to move fluid from a reservoir to the surface.

FIG. 1 is a schematic diagram of a wellbore 102 that includes an electrical submersible pump (ESP) 104 to move fluid 106 from a reservoir 108 to the surface. Generally, the reservoir 108 is formed by a cap rock layer 110 that traps the fluid 106 in the reservoir 108, for example, above an aquifer 112. As hydrocarbons are produced from the reservoir 108, the pressure in the reservoir 108 may drop, necessitating secondary oil recovery measures, such as the ESP 104.

When the ESP 104 is operational, the fluid 106 is produced to the surface, lowering the pressure in the wellbore 102 in the reservoir 108. As a result of the pressure drop, more fluid 106 flows from the reservoir 108 into the wellbore 102, for example, through perforations 114 in a casing if the wellbore 102 is lined. A packer 115 may be placed at or near the downhole end of the wellbore 102

An electrical cable 116 threaded down the wellbore 102 provides power to the ESP 104. However, the cable terminations at the top of the ESP 104 are vulnerable to corrosion from fluid 106 that includes corrosive compounds, such as $H_2S$, or $CO_2$, among others.

As used herein, the term uphole indicates that a described object is closer to the surface end of the wellbore 102, as indicated by arrow 122. Similarly, downhole indicates that a described object is farther from the surface end of a wellbore, as indicated by arrow 124.

In embodiments described herein, a completion configuration 118 that protects the cable terminations from the fluid 106 produced from the reservoir 108. The completion configuration 118 places the ESP 104 between a dual port packer 126 that is uphole of the ESP 104, and a polish bore reciprocal (PBR) with a sealbore packer 128 that is downhole of the ESP 104.

The dual port packer 126 has a tubing line in one port, which is used to carry the fluid 106 to the surface. A second port on the dual port packer 126 has a motor head for the ESP 104, which includes the cable terminations for the electrical cable 116. The cable terminations are uphole of the dual port packer 126, isolating these terminations from the fluid 106. The completion configuration 118 is described further with respect to FIG. 2.

Figure 2:
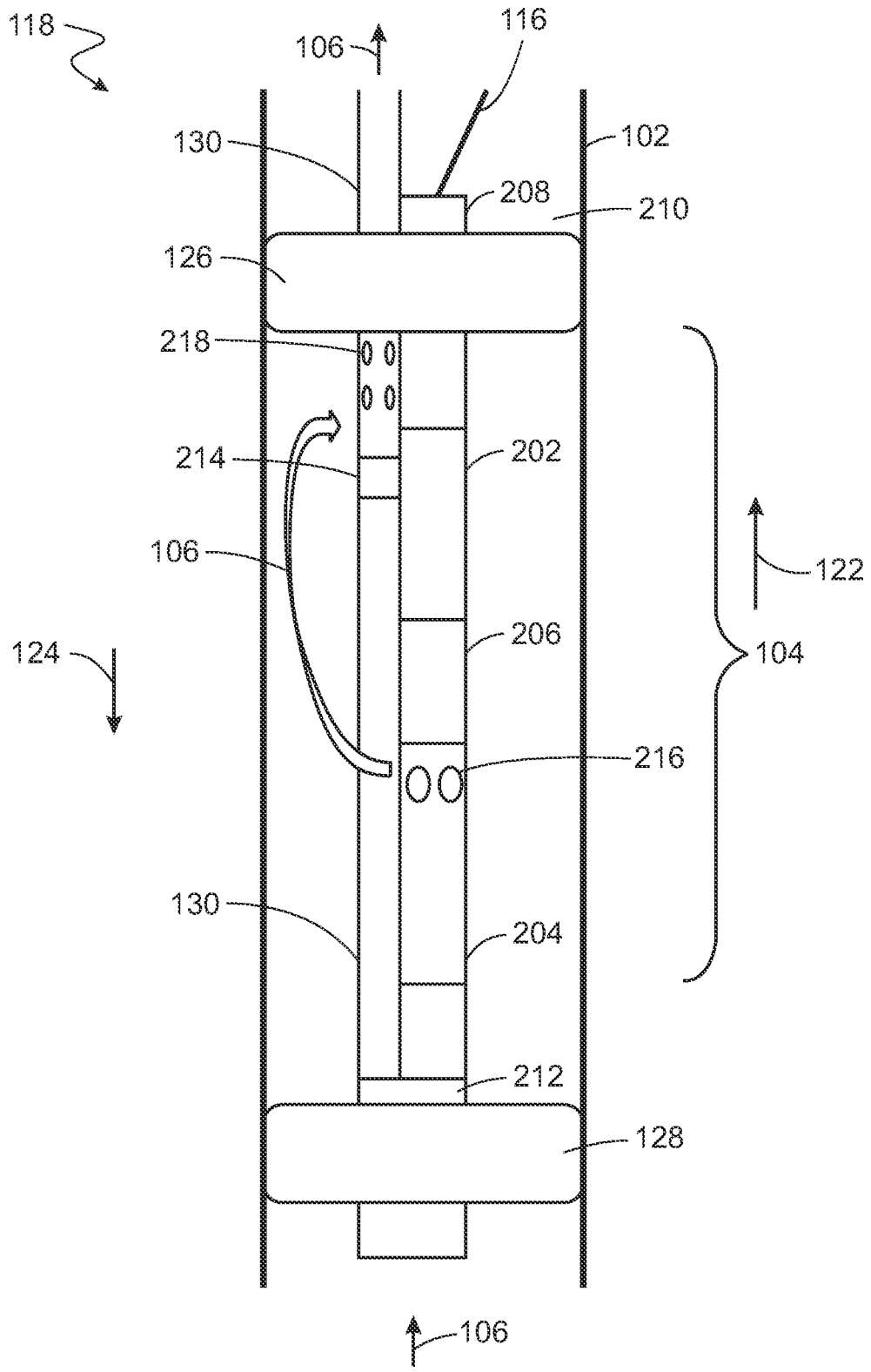
FIG. 2 is a schematic diagram of a completion configuration that isolates the ESP power terminations from well fluids.

FIG. 2 is a schematic diagram of the completion configuration 118 that isolates the power terminations from produced fluids. Like numbered items are as described with respect to FIG. 1. The ESP 104 used in the embodiment shown is inverted, e.g., with the motor 202 above the pump head 204. The shaft of the motor 202 projects through a seal 206 that prevents the fluid 106 produced from the reservoir 108 (FIG. 1) from reaching the motor 202 a motor head 208 mounts through a first port of the dual port packer 126, projecting uphole of the dual port packer 126. The wellbore 102 downhole of the dual port packer 126 is filled with the fluid 106. Uphole of the dual port packer 126, the wellbore 102 is filled with TCA fluid 210, such as well completion fluid, among others. The cable terminations of the electrical cable 116 are at, and in, the motor head 208. As the cable terminations are uphole from the dual port packer 126, they are protected from the fluid 106 and any components, such as $H_2S$, that may attack the cable terminations.

The fluid 106 enters the completion configuration 118 through a centralized stinger 212 mounted in the PBR with a sealbore packer 128. A blanking plug 214 is mounted in the bypass tubing line 130 to block the flow of fluid 106 through the interior of the tubing line 130. Accordingly, the fluid 106 flows into the intake of the pump head 204 of the ESP 104 and exits the pump head 204 through pump outlets 216 into the wellbore 102 between the sealbore packer 128 and the dual port packer 126. The fluid 106 flows into the tubing line 130 through bypass perforations 218 in the bypass tubing line 130. The bypass perforations 218 are located uphole of the motor 202 to ensure the flow of the fluid 106 provides cooling to the motor 202. The sealbore packer 128 blocks the flow of the fluid 106 from going downhole and circulating through the pump head 204, which would lower the amount of fluid entering the bypass perforations 218 and reaching the surface.

Figure 3:
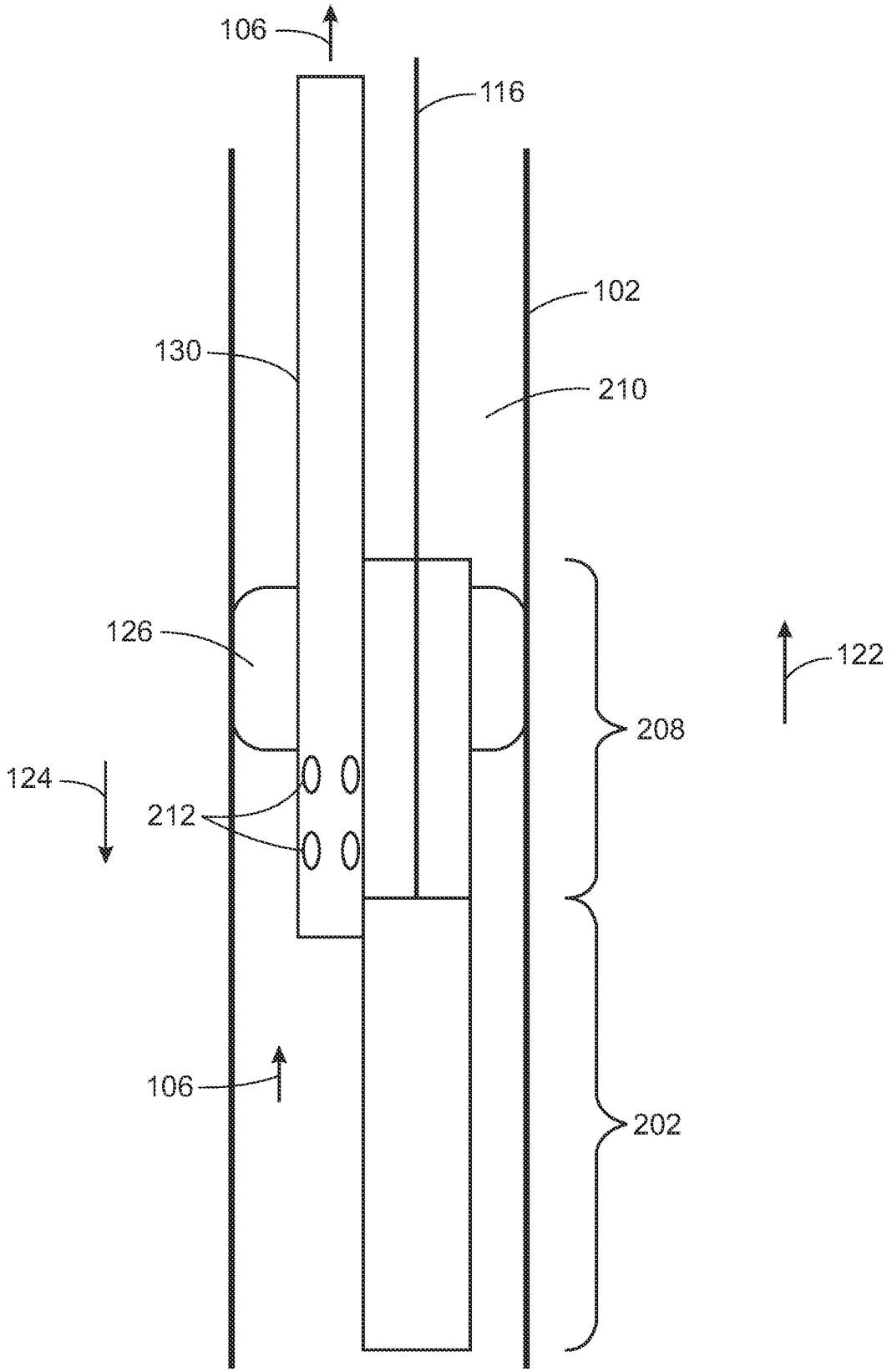
FIG. 3 is a close up view of the uphole end of the completion configuration, showing the separation of reservoir fluids from the ESP power terminations in the motor head.

FIG. 3 is a close up view of the uphole end of the completion configuration 118, showing the separation of fluids 106 from the ESP power terminations in the motor head 208. As described with respect to FIG. 2, a motor head 208 is mounted to the motor 202 to pass the power from the electrical cable 116 to the motor 202. The motor head 208 extends through the dual port packer 126, placing the cable terminations to the motor head 208 uphole of the dual port packer 126, protecting them from contact with the fluid 106 produced from the reservoir.

Figure 4:
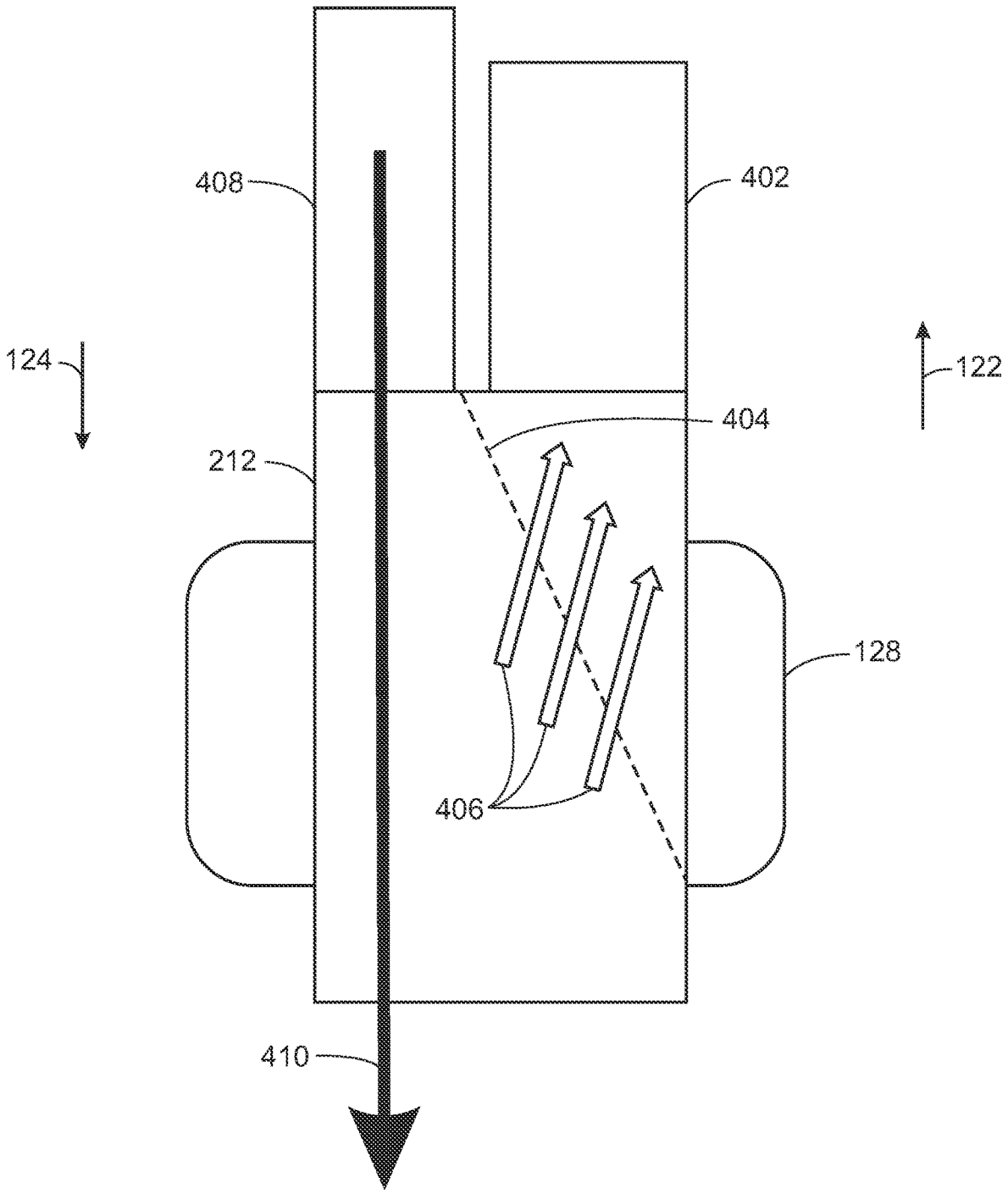
FIG. 4 is a schematic diagram of the single port packer at the downhole end of the completion configuration showing a centralized stinger through the PBR with a seal assembly.

FIG. 4 is a schematic diagram of the single port packer at the downhole end of the completion configuration 118 showing a centralized stinger 212 through the PBR with a sealbore packer 128. Like numbered items are as described with respect to FIGS. 1 and 2. The centralized stinger 212 has two branches, including a first branch 402 that couples to the inlet of the pump head 204 (FIG. 2) of the ESP 104 (FIG. 1). A perforated wall 404 allows fluid flow 406 into the inlet of the pump head 204, while blocking entrained solids from entering the pump head 204.

A second branch 408 of the centralized stinger 212 couples to the tubing line 130 (FIG. 1). Referring also to FIG. 2, during production, the tubing line 130 downhole of the bypass perforations 218 is blocked by a blanking plug 214. However, production may be halted to allow well intervention jobs. During-well intervention jobs, the blanking plug 214 can be removed to give access to the wellbore 102 through the tubing line 130, as indicated by arrow 410. Thus, coiled tubing, wire lines, and other tools can access the wellbore 102 for downhole activities.

Figure 5:
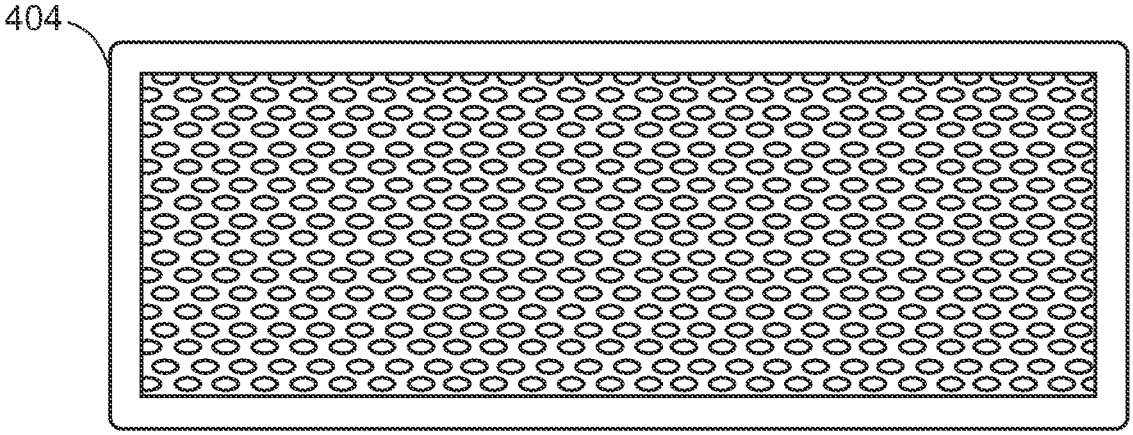
FIG. 5 is a drawing of an example of the perforated wall that can be mounted in the centralized stinger to allow fluid flow to the inlet of the pump head of the ESP.

FIG. 5 is a drawing of an example of the perforated wall 404 that can be mounted in the centralized stinger 212 to allow fluid flow to the inlet of the pump head of the ESP. The perforated wall 404 may include any number of shapes to mount in the centralized stinger and block fluid flow around the perforated wall 404. In some embodiments, the perforated wall 404 is a rectangle, as shown in FIG. 5. In other embodiments, the perforated wall is an ovoid shape with a flat surface at one end, allowing sealing to the flat top and round sides of the centralized stinger.

Figure 6:
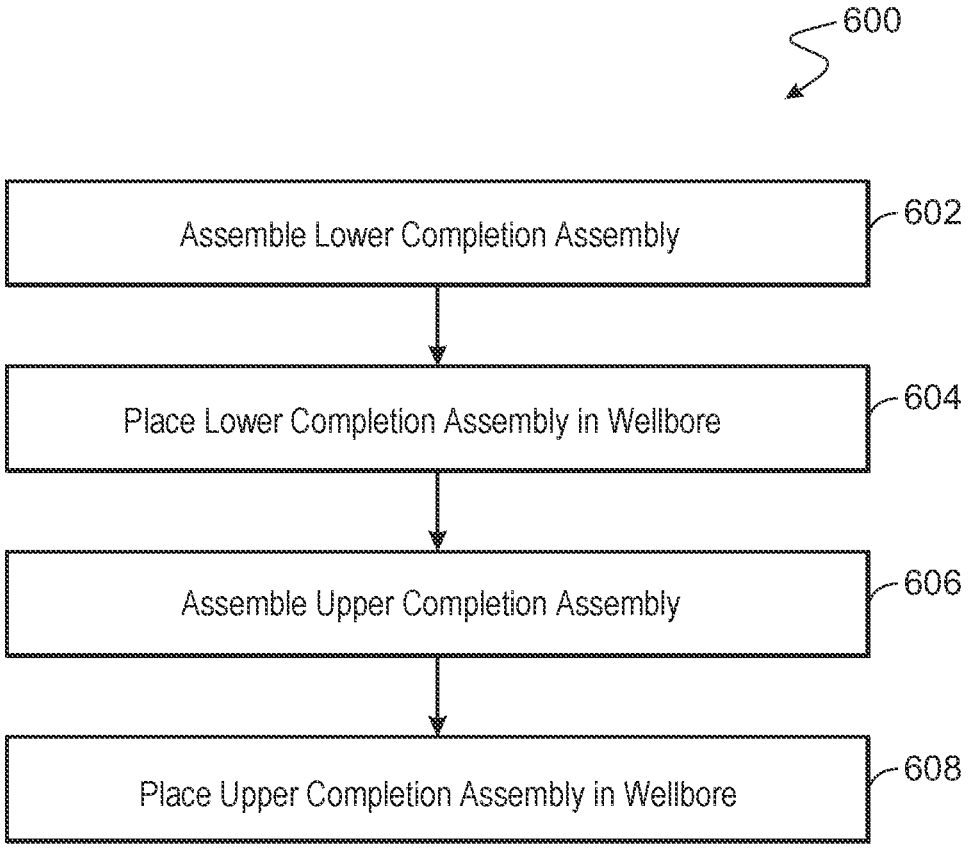
FIG. 6 is a process flow diagram of a method for installing a completion configuration that isolates the ESP power termination from well fluids.

FIG. 6 is a process flow diagram of a method 600 for installing a completion configuration that isolates the ESP power termination from well fluids. The method begins at block 602, with the assembly of the lower completion assembly, including the seal assembly and the polished bore reciprocal. At block 604, the lower completion assembly is placed in the wellbore in a first run-in-hole.

At block 606, upper completion assembly is assemble, including the stinger coupled with the ESP and bypass mounted in the dual port packer. At block 608, the upper completion assembly is inserted in a second run-in-hole. During the insertion, the upper completion assembly is joined to the lower completion assembly.

EMBODIMENTS

Embodiments described herein provide a completion configuration for an electrical submersible pump (ESP). The completion configuration includes a dual port packer, a tubing line mounted in a first port of the dual port packer, wherein the tubing line carries fluid from a reservoir to a surface, and a motor head mounted in a second port of the dual port packer, wherein the motor head couples to ESP power terminations that are disposed uphole of the dual port packer.

In an aspect, the tubing line includes bypass perforations to allow fluid entry, wherein the bypass perforations are disposed downhole of the dual port packer.

In an aspect, the completion configuration includes an inverted ESP. In an aspect, the motor for the ESP is disposed downhole of the bypass perforations. In an aspect, a length of the motor head is selected to place the motor for the ESP downhole of the bypass perforations. In an aspect, the completion configuration includes a blanking plug disposed in the tubing line downhole of the bypass perforations.

In an aspect, the completion configuration includes a sealbore packer disposed in the wellbore downhole of the ESP. In an aspect, the completion configuration includes a centralized stinger extending through the sealbore packer. In an aspect, the completion configuration includes the centralized stinger includes two branches disposed uphole of the sealbore packer.

In an aspect, the completion configuration includes a fluid intake of the ESP couples to a first branch of the centralized stinger. In an aspect, the completion configuration includes the centralize stinger includes a porous wall downhole of the fluid intake of the ESP.

In an aspect, the completion configuration includes the tubing line couples to a second branch of the centralized stinger. In an aspect, the completion configuration includes fluid outlet holes from the ESP are downhole of the motor and bypass perforations on the tubing line are uphole from the motor.

Another embodiment described in examples herein provides a method of protecting power terminations from wellbore fluids. The method includes installing an electrical submersible pump (ESP) in a wellbore, installing a tubing line in the well bore, disposed adjacent to the ESP, and mounting a dual port packer in the wellbore, wherein a motor head for the ESP passes through a first port of the dual port packer, and wherein the tubing line passes through a second port of the dual port packer.

In an aspect, the method includes mounting the dual port packer uphole of bypass perforations in the tubing line. In an aspect, the method includes mounting the dual port packer with electrical terminations for the motor head uphole of the dual port packer.

In an aspect, the method includes mounting a blanking plug downhole of inlet perforations in the tubing line. In an aspect, the method includes mounting inlet perforations on the tubing line uphole of a motor on the ESP.

In an aspect, the method includes mounting fluid outlets on the ESP downhole of the motor.

In an aspect, the method includes mounting a sealbore packer in the wellbore, wherein the sealbore packer includes a centralized stinger passing through the sealbore packer, wherein the centralized stinger includes two branches uphole of the sealbore packer. In an aspect, the method includes coupling a fluid intake for the ESP to a first branch of the centralized stinger. In an aspect, the method includes coupling the tubing line to a second branch of the centralized stinger.

Other implementations are also within the scope of the following claims.

What is claimed is:

1. A completion configuration for an electrical submersible pump (ESP), comprising:

a dual port packer;

a tubing line mounted in a first port of the dual port packer, wherein the tubing line carries fluid from a reservoir through a wellbore to a surface; and a motor head mounted in a second port of the dual port packer, wherein the motor head couples to ESP power terminations that are disposed uphole of the dual port packer.

2. The completion configuration of claim 1, wherein the tubing line comprises bypass perforations to allow fluid entry, and wherein the bypass perforations are disposed downhole of the dual port packer.

3. The completion configuration of claim 1, comprising an inverted ESP.

4. The completion configuration of claim 2, wherein the motor for the ESP is disposed downhole of the bypass perforations.

5. The completion configuration of claim 2, wherein a length of the motor head is selected to place the motor for the ESP downhole of the bypass perforations.

6. The completion configuration of claim 2, comprising a blanking plug disposed in the tubing line downhole of the bypass perforations.

7. The completion configuration of claim 1, comprising a sealbore packer disposed in the wellbore downhole of the ESP.

8. The completion configuration of claim 7, comprising a centralized stinger extending through the sealbore packer.

9. The completion configuration of claim 8, wherein the centralized stinger comprises two branches disposed uphole of the sealbore packer.

10. The completion configuration of claim 9, wherein a fluid intake of the ESP couples to a first branch of the centralized stinger.

11. The completion configuration of claim 10, wherein the centralize stinger comprises a porous wall downhole of the fluid intake of the ESP.

12. The completion configuration of claim 9, wherein the tubing line couples to a second branch of the centralized stinger.

13. The completion configuration of claim 1, wherein fluid outlet holes from the ESP are downhole of the motor and bypass perforations on the tubing line are uphole from the motor.

14. A method of protecting power terminations from wellbore fluids, comprising:

installing an electrical submersible pump (ESP) in a wellbore;

installing a tubing line in the well bore, disposed adjacent to the ESP; and mounting a dual port packer in the wellbore, wherein a motor head for the ESP passes through a first port of the dual port packer, and wherein the tubing line passes through a second port of the dual port packer.

15. The method of claim 14, comprising mounting the dual port packer uphole of bypass perforations in the tubing line.

16. The method of claim 14, comprising mounting the dual port packer with electrical terminations for the motor head uphole of the dual port packer.

17. The method of claim 14, comprising mounting a blanking plug downhole of inlet perforations in the tubing line.

18. The method of claim 14, comprising mounting inlet perforations on the tubing line uphole of a motor on the ESP.

19. The method of claim 14, comprising mounting fluid outlets on the ESP downhole of the motor.

20. The method of claim 14, comprising mounting a sealbore packer in the wellbore, wherein the sealbore packer comprises a centralized stinger passing through the sealbore packer, wherein the centralized stinger comprises two branches uphole of the sealbore packer.

21. The method of claim 20, comprising coupling a fluid intake for the ESP to a first branch of the centralized stinger.

22. The method of claim 20, comprising coupling the tubing line to a second branch of the centralized stinger.

* * * * *